US009940940B2

(12) United States Patent
Craven et al.

(10) Patent No.: US 9,940,940 B2
(45) Date of Patent: Apr. 10, 2018

(54) TRANSPARENT LOSSLESS AUDIO WATERMARKING

(71) Applicants: Peter Graham Craven, Haslemere (GB); Malcolm Law, Steyning (GB)

(72) Inventors: Peter Graham Craven, Haslemere (GB); Malcolm Law, Steyning (GB)

( * ) Notice: Subject to any disclaimer, the term of this patent is extended or adjusted under 35 U.S.C. 154(b) by 0 days.

(21) Appl. No.: 15/300,598

(22) PCT Filed: Mar. 26, 2015

(86) PCT No.: PCT/GB2015/050910
§ 371 (c)(1),
(2) Date: Sep. 29, 2016

(87) PCT Pub. No.: WO2015/150746
PCT Pub. Date: Oct. 8, 2015

(65) Prior Publication Data

US 2017/0116996 A1 Apr. 27, 2017

(30) Foreign Application Priority Data

Apr. 20, 2014 (GB) ..... 1405958.8

(51) Int. Cl.
*G10L 19/018* (2013.01)
*G10L 19/032* (2013.01)
(Continued)

(52) U.S. Cl.
CPC ..... *G10L 19/018* (2013.01); *G10L 19/0017* (2013.01); *G10L 19/032* (2013.01); *G10L 19/10* (2013.01)

(58) Field of Classification Search
CPC ..... G10L 19/018
See application file for complete search history.

(56) References Cited

U.S. PATENT DOCUMENTS 6,219,634 B1 * 4/2001 Levine ..... G10L 19/018 704/200.1
6,233,347 B1 * 5/2001 Chen ..... H04H 20/31 382/100
2008/0267412 A1 * 10/2008 Oostveen ..... G10L 19/018 380/287

FOREIGN PATENT DOCUMENTS

EP 2544179 A1 1/2013
GB 2495918 A 5/2013
(Continued)

OTHER PUBLICATIONS

Steinebach, Martin, and Jana Dittmann. "Watermarking-based digital audio data authentication." EURASIP Journal on Applied signal processing 2003 (2003): 1001-1015.*
(Continued)

*Primary Examiner* — Brian L Albertalli
(74) *Attorney, Agent, or Firm* — Buckley, Maschoff & Talwalkar LLC

(57) ABSTRACT

An encoding method and encoder is provided for transparent lossless audio watermarking by quantizing an original PCM audio signal twice, each quantization quantizing to a quantization grid. As a PCM signal is inherently already quantized, there are three quantization grids to consider, the first being the quantization grid of the original PCM signal, the second being that of the watermarked signal and the third being that of an intermediate signal. The technique reduces the amount of introduced quantization error, spectrally shapes the error and fully decorrelates signal alterations from the original audio, thus making the error more similar to additive noise. A decoding method and decoder is also provided, as is a method of altering the watermark without fully decoding the encoded signal.

26 Claims, 6 Drawing Sheets

(51) Int. Cl.
*G10L 19/00* (2013.01)
*G10L 19/10* (2013.01)

(56) References Cited

FOREIGN PATENT DOCUMENTS

| | | | | | |
|---|---|---|---|---|---|
| GB | 2524784 | A | 10/2015 | | |
| WO | 94/18762 | A1 | 8/1994 | | |
| WO | 95/18523 | A1 | 7/1995 | | |
| WO | 2004/066272 | A1 | 8/2004 | | |
| WO | WO 2004066272 | A1 * | 8/2004 | ..... | G10L 19/018 |
| WO | WO 2004102464 | A2 * | 11/2004 | ..... | G06T 1/0092 |
| WO | 2013/061062 | A2 | 5/2013 | | |

OTHER PUBLICATIONS

Nishimura, Akira. "Reversible and robust audio watermarking based on quantization index modulation and amplitude expansion." International Workshop on Digital Watermarking. Springer Berlin Heidelberg, 2013.*

Agaian, Sos S., et al. "Lossless adaptive digital audio steganography." Signals, Systems and Computers, 2005. Conference Record of the Thirty-Ninth Asilomar Conference on. IEEE, 2005.*

Gerzon, Michael A. et al. "A High-Rate Buried-Data Channel for Audio CD", J. Audio Eng. Soc., vol. 43, No. 1/2, Jan. 1, 1995 (Jan. 1, 1995), January/February, XP000733672, ISSN: 1549-4950, (pp. 3-22, 20 total pages).

"Patents Act 1977: Further Search Report under Section 17", dated Jul. 8, 2015, for GB Application No. 1405958.8, 1pg.

"Patents Act 1977: Search Report under Section 17", dated Oct. 6, 2014, for GB Application No. 1405958.8, 1pg.

"PCT Notification of Transmittal of the International Search Report and the Written Opinion", International Searching Authority, dated Jun. 9, 2015 (dated Sep. 6, 2015), for International Application No. PCT/GB2015/050910, 13pgs.

"Patents Act 1977: Examination Report under Section 18(3)", dated Apr. 4, 2016, for GB Application No. 1405958.8, 2pgs.

* cited by examiner

TRANSPARENT LOSSLESS AUDIO WATERMARKING

CROSS-REFERENCE TO RELATED APPLICATIONS

This application is a U.S. National Stage filing under 35 U.S.C. §371 and 35 U.S.C §119, based on and claiming priority to PCT/GB2015/050910 for "TRANSPARENT LOSSLESS AUDIO WATERMARKING" filed Mar. 26, 2015, claiming priorities to GB Patent Application No. 1405958.8 filed Apr. 2, 2014.

FIELD OF THE INVENTION

The invention relates to the insertion of an audibly transparent reversible watermark into a PCM audio signal, with particular reference to streamed transmission.

BACKGROUND TO THE INVENTION

In the present millennium, several reversible watermarking schemes for audio have been proposed, though on inspection the reversibility is often in the sense of Numerical Analysis, and the reconstruction of an original PCM (Pulse Code Modulation) signal is not lossless, i.e. bit-for-bit accurate, in the presence of the inevitable quantisations within the algorithm. Two algorithms that we consider truly lossless are "Reversible Watermarking of Digital Signals" by M. Van Der Veen, A. Bruekers, A. Van Leest and S. Cavin, published as WO2004066272 and "Lossless Buried Data" by P. Craven and M. Law, published as WO2013061062.

WO2004066272 discloses methods for the reversible watermarking of digital signals by manipulating the histogram of the audio. According to one method, a sigmoid gain function C is applied to an original 16-bit PCM audio signal which is then requantised to 15 bits, leaving a 1 bit hole in the least significant bit position (lsb). Into this lsb hole is inserted data comprising the desired watermark data, overhead and reconstruction data to allow the corresponding decoder to reverse the watermarking process and recover an exact replica of the original audio.

The sigmoid gain function has a gain exceeding 1 near 0 and maps the range of audio signals to itself. Consequently, it must have a gain less than 1 near full scale. Over any range of signal values where the gain of C is less than 2, reconstruction data is required because C maps the 16-bit values that lie within the range on to fewer distinct 15 bit values. Where the gain of C is also greater than 1 there is less than one bit per sample of reconstruction data required and where it is less than 1 there is more than one bit of reconstruction data required. The scheme works because the PDF (Probability Density Function) of signal values audio is not flat, small signal values (where the sigmoid shape of C has gain greater than 1) being more common than large values (where C has gain less than 1). Thus, on average, there is less than 1 bit per sample of reconstruction data (usually much less) leaving sufficient space within the lsb hole for overhead and watermark.

Whilst this method is effective at embedding large amounts of watermark data, there are a number of respects in which the transparency is less than may be desired. The watermark data is additive into the signal so patterns in it may be audible, and the signal modification is just as loud in the frequency regions where the ear is most sensitive as where it is less sensitive. The method also does not offer the flexibility to provide reduced noise in exchange for reduced watermark capacity.

WO2013061062 discloses how the sigmoid gain function may be implemented as the combination of a linear gain and a clipping unit which generates reconstruction data when signal peaks are clipped. It also discloses how separate lossless filtering can be advantageously be used in conjunction with the scheme to modify the signal's PDF in order to reduce the quantity of reconstruction data generated by the clipping unit. Nevertheless it is difficult to see how the audiophile ideal of a low and constant noise floor, uncorrelated with the audio signal and preferably spectrally shaped, may be achieved using the methods of either WO2004066272 or WO2013061062.

A transparent lossy watermarking scheme is described by M. Gerzon and P. Craven in "A High Rate Buried Data Channel for Audio CD", preprint 3551 presented at the 94th AES Berlin Convention 1993 (hereinafter Gerzon). Watermark data comprising n binary bits per sample is randomised and then used as subtractive dither to a noise-shaped (16−n) bit quantiser. This has the practical effect of discarding the n lsbs of the audio and replacing them by the randomised watermark but with far less harm to the audio than plain replacement of bits. Joint quantisation of two stereo channels is described which allows n to be an odd multiple of ½, as well as more complicated quantisation schemes.

The streaming of audio material is now very popular, and raises the technical requirement that a decoder must be able to commence decoding without seeing the beginning of an encoded item or "track". In the context of lossless reconstruction an economically-encoded stream, this requirement may present significant technical hurdles, as will be evident.

SUMMARY OF THE INVENTION

It is an object of the present invention to furnish a lossless watermarking process having improved transparency compared to that of WO2004066272, as heard on standard "legacy" PCM decoding apparatus that does not incorporate the features of the invention, while retaining the ability of the prior art system to start decoding from the middle of an encoded stream. This is done by reducing the amount of introduced quantisation error, spectrally shaping the error and fully decorrelating signal alterations from the original audio, thus making the error more similar to additive noise. Attention is also paid to the ease of altering the watermark.

As will be described in more detail, an encoder according to the invention quantises an original PCM signal twice, each quantisation quantising to a quantisation grid. As a PCM signal is inherently already quantised, there are three quantisation grids to consider, the first being the quantisation grid of the original PCM signal, the second being that of the watermarked signal and the third being that of an intermediate signal.

Normally, the watermarked signal is delivered as a PCM signal having the same bit-depth as the original signal, but this does not imply that the first and second quantisation grids are the same. In general, the quantisation grid of a signal may not be the set of values obtained by interpreting possible all combinations of bits within the PCM representation as binary numbers. We shall consider some signals that are constrained to exercise only a coarser subset of the above set of values. Conversely, we shall also consider signals whose values are offset from the values in the above by set by an amount that is not an integer multiple of the quantisation step size. The offset may vary from one sample to another provided the sender and receiver of the signal have synchronised knowledge of the offset, for example if the offset is generated from data common to both or from a pseudorandom sequence generator known to both.

These considerations apply both to single channel signals and multichannel signals, whose sample values are multidimensional vectors lying on the grid points of a multidimensional grid. A further point of interest in the vector case is that an n-dimensional grid may be a simple rectangular, cuboidal or hypercuboidal grid, in other words the Cartesian product of n one-dimensional grids, or it may be something more general, for example resulting from a constraint that the exclusive-OR of the least-significant-bits of the n channels be zero. A PCM channel can be viewed as a container having its own quantisation grid, and the quantisation grid of a PCM signal transmitted through the channel may be coarser. Thus, the quantisation grid of a PCM signal cannot be deduced simply from a knowledge of its bit-depth.

Quantisation is normally thought of as a process that discards information, but this is not necessarily the case if a signal that is already quantised is re-quantised to a quantisation grid that is not coarser than the original quantised grid. We shall use the term 'quantisation' to refer to a mapping of signal values to nearby values on a quantisation grid, whether information is lost or not.

When referring to 'noise' or to a 'signal-to-noise ratio', we are considering noise heard when the watermarked signal is reproduced on standard PCM equipment. Of course, if the watermarked signal is decoded losslessly according to the invention, then there is no additional noise from watermarking.

The invention in a first aspect provides a method for losslessly watermarking an original or 'first' audio signal to generate a watermarked 'second' audio signal, both signals being pulse code modulated 'PCM' signals and each being quantised to its respective 'first' or 'second' quantisation grid. The method comprises the steps of:

- receiving the first audio signal as samples quantised on a first quantisation grid;
- determining a third quantisation grid coarser than the first quantisation grid;
- applying a quantised mapping to the first audio signal to furnish a third audio signal having sample values that lie on the third quantisation grid;
- generating first data when multiple values of the first quantisation grid would be mapped to the value of the third audio signal by the quantised mapping, wherein the first data is reconstruction data that indicates which of the multiple values is the value of the first audio signal;
- combining the first data with watermark data to produce second data;
- determining a second quantisation grid different than the first and third quantisation grids in dependence on the second data; and,
- generating samples of the second audio signal by quantising the third audio signal onto the second quantisation grid in dependence on previous samples of the second audio signal.

In their most basic forms, the first four steps of 'receiving', 'determining', 'applying' and 'generating' are similar to operations of the prior art process described in WO2004066272. The 'quantised mapping' quantises the original signal to 'third' signal on a third quantisation grid which is generally coarser than the first, resulting in a loss of signal resolution so that subsequent lossless recovery of the first signal requires additional reconstruction data. This reconstruction data is the 'first' data generated in the process of applying the quantised mapping.

The second audio signal is presented as a PCM signal, but as discussed a PCM signal may have a quantisation grid coarser than that of a PCM channel that contains it. If the second quantisation grid were fixed, this would imply that some points of the quantisation grid associated with the channel would never be exercised. This provides the opportunity to quantise the third signal to a varying second quantisation grid, and according to the invention the second quantisation grid is determined in dependence on 'second' data, which comprises both the watermark and the 'first' reconstruction data referred to above. In this way the second data is 'buried' within the watermarked signal, and a subsequent decoder can recover the buried data by inspecting which points of the channel's quantisation grid have been exercised.

If the quantised mapping had a large-signal gain of unity, the maximum amount of 'second' data that could be buried thus and subsequently recovered would be the same as the amount of 'first' reconstruction data and there would be no opportunity to convey a watermark. However in normal operation the quantised mapping is configured to provide gain greater than unity over signal ranges covering the most commonly occurring signal values. This reduces the amount of reconstruction data required, thus allowing the second data to carry the desired watermark data and any necessary system overheads.

Thus, the quantised mapping is generally not linear. As discussed in WO2004066272, it may have a sigmoid shape. Alternatively, as discussed in WO2013061062, it may be linear with a gain greater than unity over the central portion of the signal range but with special provisions to avoid overload near the extremes of the signal range.

When the first audio signal takes a value where the gain of the first mapping is less than unity, the reconstruction data is temporarily larger than the maximum second data that can be buried. The excess data can be accommodated by buffering the reconstruction data. Since buffering incurs delay, with simple buffering it will be necessary for a decoder to read the stream and start decoding some time later; alternatively an encoder may insert delay in the third signal so that a decoder will receive the buffered reconstruction data at the correct time.

The quantisation from the third grid to the second grid is performed in dependence on previous samples of at least one of the second and third audio signals in order to provide spectral shaping and reduce the perceptual significance of the resulting quantisation noise. This technique is widely used in other contexts, but it is not obvious to use it where lossless reconstruction may be required in the context of streamed audio because the dependency on previous samples can make it difficult or impossible to start the reconstruction from partway through a stream.

In some system embodiments the said dependency is on a finite number n of previous samples of the third audio signal and the second audio signal. A decoder receives the second audio signal directly so the dependency on previous samples of the second audio signals is resolved merely by waiting for n sample periods. This is not the case for the third audio signal so in a preferred embodiment, an encoder supports decoding from a 'restart point' by including within the second data initialisation data relating to a portion of the third audio signal comprising n consecutive samples.

The restart assistance data could straightforwardly comprise a binary representation of the n previous samples of the third audio signal, but in a system providing 16 bits of audio resolution that would require at least n×16 bits of 'restart assistance data' for each audio channel at each place in the stream where decoding might commence. This requirement can be very significantly reduced by noting that, assuming suitable noise shaping filter, a strict bound can be placed on the difference between the third audio signal and the second audio signal. Thus, given knowledge of a sample of the second audio signal, the corresponding sample of the third audio signal can be reconstructed completely from information defining a selection of its bits.

In a further preferred embodiment the encoder therefore provides initialisation data relating to only a selection of bits of the third audio signal, the selection having for example fewer than eight bits. The total number of bits of the third audio signal relating to a particular restart point thereby does not exceed eight times the number of channels times the number n of consecutive samples in the portion, times the number of channels.

It is preferred that at least one of the first and third quantisation grids varies from sample to sample. If this were not the case, these two grids would be in a fixed relationship and the quantised mapping to the third would need to incorporate dither to avoid quantisation artefacts, but dither incurs a noise penalty.

In a preferred embodiment, the third quantisation grid is varied in dependence on the output of a pseudo-random sequence generator in order to ensure that the quantisation error introduced by the quantised mapping is decorrelated from the first audio signal.

In a preferred embodiment, the first audio signal is multichannel and at least one of the second and third quantisation grids is not formed as the Cartesian product of an independent quantisation grid on each channel. Using known quantisation methods, the additional noise from signal requantisations can then be reduced compared to independent quantisation of channels.

As well as providing a watermarked signal whose large-signal behaviour closely matches the original, the invention also admits signal modification and in particular filtering to adjust the frequency response. Lossless filters are known in the prior art, for example WO 96/37048, but inevitably they require quantisation to the same bit-depth as the signal being processed, and noise when reproduced on 'legacy' equipment is inevitably increased. The invention allows a filter using finer quantisation used in order to minimise the noise increased.

Thus, in some embodiments, the quantised mapping is preceded by a filter whose output is quantised more finely than the first quantisation grid. In a preferred embodiment, the filter is configured as a side-chain which adds an adjustment value to the forward signal path, where the adjustment value is a linear or nonlinear deterministic function of previous samples of the filter's input and output. Such an addition can be inverted losslessly, even though the adjustment value is quantised more finely than the forward signal path. The fine quantisation reduces the additional noise from the filtering.

The invention in a second aspect provides a method for retrieving a first audio signal and watermark data from a portion of a second audio signal, wherein the first and second audio signals are pulse code modulated 'PCM' signals, and wherein the second audio signal is a losslessly watermarked PCM signal and the first audio signal has samples that lie on a first quantisation grid, the method comprising:

determining a third quantisation grid;

receiving the second audio signal as quantised samples;

retrieving first data and the watermark data from the second audio signal, wherein the first data is reconstruction data for use in retrieving the first audio signal;

generating samples of a third audio signal, quantised onto the third quantisation grid, by quantising samples of the second audio signal in dependence on previous samples of at least one of the second and third audio signals;

applying a quantised mapping to the third audio signal in dependence on the first data, to furnish a mapped signal; and, furnishing the first audio signal in dependence on the mapped signal.

Typically, the first audio signal replicates losslessly a portion of an original PCM audio signal that was presented to an encoder and the second audio signal is a watermarked version of the original PCM audio signal. The signals are have quantised samples, the first audio signal having samples that lie on a first quantisation grid. The third quantisation grid is generally chosen to be coarser than the first, a feature that is generally necessary if the third signal is to be independent of the watermark, so that the third signal carries audio information from the first signal only. The coarser resolution implies a loss of some of the original audio information, but this information is carried within the first data, also known as "reconstruction data". In the step of applying a quantised mapping, the reconstruction information within the first data is combined with the more coarsely quantised third signal, so that the mapped signal has full resolution.

Straightforwardly, the mapped signal is equal to the first signal so the method step of 'furnishing' is a null operation. In some embodiments however, the furnishing may incorporate further functionality such as the addition of an adjustment sample as will be explained below.

It is preferred that at least one of the first and third quantisation grids varies from sample to sample. If this were not the case, the two grids would be in a fixed relationship and the corresponding two grids in a corresponding encoder would also need to be in a fixed relationship if the decoding method is to be lossless. Consequently, the quantised mapping in the corresponding encoder would need to incorporate dither to avoid quantisation artefacts, but dither incurs a noise penalty if the watermarked signal is reproduced on standard PCM equipment.

In a preferred embodiment, the third quantisation grid is determined in dependence on the output of a pseudo-random sequence generator. Similarly to the above, this requirement is needed to ensure that the quantisation error introduced by the quantised mapping in a corresponding encoder is decorrelated from the first audio signal.

In a preferred embodiment, the first, second and third audio signals are multichannel and at least one of the second and third quantisation grids is not formed as the Cartesian product of an independent quantisation grid on each channel. Again, by arguments similar to the above, using known quantisation methods, the additional noise from signal requantisations in a corresponding encoder can then be reduced compared to independent quantisation of channels.

In some embodiments, the first signal is produced directly by the quantised mapping, so the first signal is equal to mapped signal. However, in order to provide lossless reconstruction from a watermarked signal that has been derived from a modified first signal, the method may further comprise the steps of:

determining a fourth quantisation grid finer than the first quantisation grid;

computing an adjustment sample dependent on previous samples of at least one of the first audio signal and the mapped signal, the adjustment sample having a value lying on the fourth quantisation grid; and, adding the adjustment to the mapped signal.

Such an embodiment allows use with watermarked signals encoded using an encoder which subtracts a corresponding adjustment from the first signal, thereby providing the functionality of a filter. As explained above, this allows the watermarked signal, when interpreted as a plain PCM signal, to have a different frequency response from the original 'first' signal and yet with less noise than if the frequency response modification had been performed using a separate lossless filter. For the decoding method to be lossless, the adjustment value also needs to be communicated to the quantised mapping, as will be explained below.

In a preferred embodiment, the decoding method of the second aspect comprises the additional steps of:

retrieving initialisation data from the second audio signal; and, using the initialisation data to determine a selection of bits from consecutive samples of the third audio signal.

This feature relates to the decoding of a stream from a 'restart point' rather than from the beginning. As explained earlier, once a selection of bits within each of the consecutive samples has been determined, the consecutive samples of the third audio signal can be reconstructed completely. Since samples of the second audio signal are received directly, this provides sufficient initialisation data to allow a noise-shaping or other filter in the decoder to mimic precisely the operation of a corresponding filter in the encoder which, as explained elsewhere is sufficient for the decoder to determine the third audio signal from that time onwards.

Preferably, the system is configured so that the initialisation data received for the purpose of determining the third audio signal is no greater than 8 bits times the number of channels times the number of values of the third audio signal. This minimises the stream overhead and, as explained earlier is facilitated by using a suitable noise shaping filter and predetermining a strict bound on the difference between the third audio signal and the second audio signal.

The invention in a third aspect provides also a method for altering the watermark in a second audio signal that is a losslessly watermarked PCM signal generated according to the method of the first aspect. The alteration is achieved without fully recovering the original signal and re-encoding, which would be more expensive computationally.

In this third aspect the method comprises the steps of:

receiving the second audio signal as quantised samples;

retrieving second data comprising embedded watermark data from the second audio signal;

generating samples of a third audio signal, quantised onto a third quantisation grid, by quantising the second audio signal in dependence on previous samples of at least one of the second and third audio signals;

producing fourth data by altering the embedded watermark data in the second data;

determining a fourth quantisation grid in dependence on fourth data; and, quantising third audio signal to fourth audio signal on fourth quantisation grid in dependence on previous samples of at least one of the fourth and third audio signals.

It will be seen that the method steps of this third aspect correspond substantially to the first few steps of the second aspect and the last few steps of the first aspect.

In order to provide compatibility with preferred embodiments of the first and second aspects, it is preferred that the third quantisation grid varies from one sampling instant to another. Similarly, it is preferred that the third quantisation grid is chosen determined in dependence on the output of a pseudo-random sequence generator.

In applications where the second, third and fourth audio signals are multichannel it is preferred that at least one of the second, third or fourth quantisation grids is not formed as the Cartesian product of an independent quantisation grid on each channel. This preference is for compatibility with encoders and decoders having similar preferred properties.

In a fourth aspect, the invention provides an encoder adapted to losslessly watermark a PCM audio signal using the method of the first aspect. Also provided is a watermark modifier adapted to alter the watermark using the method of the third aspect.

In a fifth aspect, the invention provides a decoder adapted to retrieve a PCM audio signal and watermark data from a portion of a losslessly watermarked PCM signal using the method of the second aspect.

In a sixth aspect, the invention provides a codec comprising an encoder according to the fourth aspect in combination with a decoder according to the fifth aspect.

In a seventh aspect, the invention provides a data carrier comprising a PCM audio signal losslessly watermarked using the method of the first aspect.

In an eighth aspect a computer program product comprises instructions that when executed by a signal processor causes said signal processor to perform the method of any one of the first to third aspects.

Although the method according to the third aspect can advantageously be used to alter a losslessly-watermarked PCM audio that has been generated according to the method of the first aspect, it is also capable of independent utility to alter any suitable losslessly-watermarked PCM audio. Again, the alteration is achieved without fully recovering the original signal and re-encoding, which would be more expensive computationally Accordingly, the invention in an ninth aspect provides a method for altering the watermark in an input audio signal that is a losslessly-watermarked PCM signal, the method comprising the steps of:

receiving the input audio signal as quantised samples;

retrieving input data comprising embedded watermark data from the input audio signal;

generating samples of an intermediate audio signal, quantised onto an intermediate quantisation grid, by quantising the input audio signal in dependence on previous samples of at least one of the input audio and intermediate audio signals;

producing output data by altering the embedded watermark data in the input data;

determining an output quantisation grid in dependence on the output data; and, quantising the intermediate audio signal to an output audio signal on the output quantisation grid in dependence on previous samples of at least one of the output and intermediate audio signals.

In some embodiments the intermediate quantisation grid varies from one sampling instant to another.

In some embodiments the intermediate quantisation grid is determined in dependence on the output of a pseudo-random sequence generator.

In further aspects, the invention provides a watermark modifier adapted to alter a watermark using the method of the ninth aspect, and also a computer program product comprising instructions that when executed by a signal processor causes said signal processor to perform the method of the ninth aspect.

As will be appreciated, the present invention provides various methods and devices for encoding and decoding a PCM audio signal losslessly with a watermark and for altering the watermark in the losslessly watermarked PCM signal. Further variations and embellishments will become apparent to the skilled person in light of this disclosure.

BRIEF DESCRIPTION OF THE DRAWINGS

Examples of the present invention will be described in detail with reference to the accompanying drawings, in which.

DETAILED DESCRIPTION

Figure 1A:
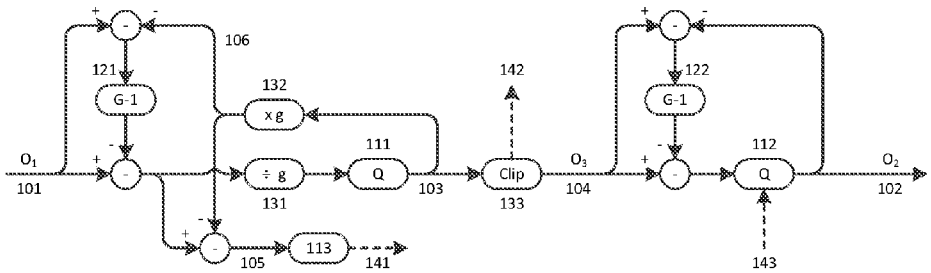
FIG. 1A is a signal-flow diagram of an encoder according to an embodiment of the invention.

In the process known as "subtractive dither", a random deviate is added to a signal, the resultant value is then quantised and the same deviate then subtracted again. Subtractive dither is known to increase the transparency of a quantisation by making the quantisation error noiselike and independent of the signal being quantised, as discussed by M. Gerzon and P. Craven in "A High Rate Buried Data Channel for Audio CD", preprint 3551 presented at the 94th AES Berlin Convention 1993 (hereinafter "Gerzon").

As Gerzon points out, true subtractive dither requires the random deviate to be drawn from a continuous distribution. In our embodiments we will need the deviates to have a finite number of bits so as to control the wordwidth of the subtractively dithered signal which will be used as an input to multipliers. 8 bits of random deviate is adequate for our purposes, moving any quantisation artifacts down from around the 16 bit level to around the 24 bit level whilst still allowing plenty of room for 16 bit audio in a 32 bit word.

Generally, a lattice quantiser is used so that, prior to subtraction, the quantised value lies on a quantisation lattice. One could just as well subtract before the quantisation and add afterwards. In this case the resultant values lie on the quantisation lattice plus an offset given by the random deviate. This offers an alternative perspective on subtractive dither, that the whole operation is one of quantisation onto a randomised grid.

We shall use the term "quantisation offset" to denote the offset of this grid from the lattice defining the quantisation. We shall frequently consider quantisation offsets that vary from sample to sample of the audio signal, usually generated by a pseudorandom sequence generator, but sometimes with some modification and sometimes generated by other means.

We shall also use the term "quantisation grid" to mean the set of points that the quantiser could output, which is a combination of the quantisation lattice and the offset. If the quantisation offset varies from sample to sample then so will the quantisation grid.

Where we talk of using pseudorandom number generators we will require their outputs to match between encoder and decoder. This can be done by including sample number data in the overhead to be conveyed alongside the watermark. When a decoder commences operation partway through a track it can use that sample number data to seek to the correct place in the pseudorandom sequences so that the subsequent output of its pseudorandom number generator will match that used in the encoder.

The invention now will be explained with reference to an embodiment which processes 2 channels of 16-bit PCM audio. There is nothing special about the number 16 however and the skilled person will have no difficulty in adapting the disclosure to other bit-depths or quantisation schemes. The person familiar with Gerzon should also have no difficulty in generalising to one or many channels.

Input to the watermarker may come from a source such as CD whose samples on each channel are quantised on a lattice $\{2^{-16}k\}$, $k \in \mathbb{Z}$ consisting of all integer multiples of $2^{-16}$. However we keep open the possibility that it has been generated by a subtractive dither process and has a pseudorandom quantisation offset known to the watermarker and programmed into the watermark restorer or decoder. We thus speak of the input to the watermarker and the output from a subsequent restorer having a 'first quantisation offset'. In the CD case this will be zero for all samples, in the case where audio is provided by a subtractive dither process it will be given by an agreed pseudorandom sequence.

Our watermarker will follow WO2013061062 in applying a gain of $g^{-1}$ (where $g<1$) to the audio and cope with any resultant overload by soft clipping the resultant audio (using the clip unit 133 and the inverse operation, the unclip unit 233). The combination of gain and clipping corresponds to the sigmoid gain function of WO2004066272.

The invention will be described with reference to FIGS. 1A and 1B. A two channel 16 bit PCM audio signal is considered as comprising samples each of which is a two dimensional vector whose components are quantised to 16 bits. In FIG. 1A, such a signal 101 quantised to a lattice having a quantisation offset $O_1$ is presented to the encoder. The sample values of the PCM signal are divided 131 by a gain g (where $g<1$) and then quantised 111 onto a coarser quantisation lattice to yield an intermediate signal 103. This coarser grid jointly quantises both channels to a 15.5 bit level where the quantisation lattice is defined by $\{[2^{-16}, 2^{-16}]\ [2^{-16}, -2^{-16}]\}$, with a pseudorandom offset $O_3$. Hence the quantisation grid is $[2^{-16}(j+k), 2^{-16}(j-k)]+O_3$ where $j, k \in \mathbb{Z}$.

Assuming for now that the clip unit 133 does not modify the signal (as is true for much of the range), then signal 104 is a replica of signal 103. Signal 104 is then quantised again 112 onto the same 15.5 bit lattice but with an offset chosen in dependence on data 143 (comprising the watermark) to yield an output signal 102 which has the effect of embedding data 143 into the output signal 102. The offset is [0,0] to embed a 0 and $[0, 2^{-16}]$ to embed a 1, so data 143 is contained in the parity of the lsbs of the two channels in a similar manner to that described in Gerzon.

Figure 1B:
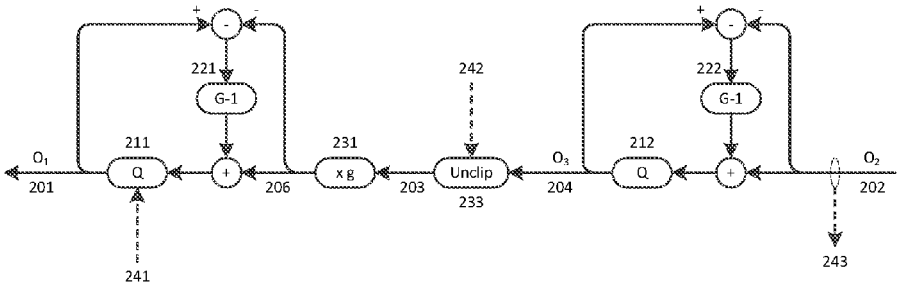
FIG. 1B is a signal-flow diagram of a decoder corresponding to the encoder of FIG. 1A.

As shown in FIG. 1B, a corresponding decoder receives a replica 202 of the audio output 102 from the encoder. Data 243, a replica of 143, is recovered by determining which quantisation offset $O_2$ was used by inspection of the sample values. Signal 202 is then quantised 212 onto the 15.5 bit lattice above, with quantisation offset $O_3$ such that the quantisation error introduced by quantiser 212 is the opposite of that introduced by quantiser 112 so that signal 204 replicates signal 104. Unclip unit 233 inverts clip unit 133, so signal 203 replicates signal 103. This signal is then multiplied by g 231 and quantised 211 onto the 16 bit lattice with quantisation offset $O_1$. Quantiser 211 does not always output the nearest quantised value to its input as will be later described with reference to FIG. 2. It takes in reconstruction data which may adjust its output by $+2^{-16}$ on either channel, which is arranged to replicate the value on signal 101 establishing lossless operation.

Filters 121, 221, 122, 222 are also arranged so that the decoder versions receive input signals replicating those in the encoder and consequently, subject to suitable initialisation on startup, their outputs also match. Their effect is to shape the quantisation error introduced by the quantisers, so that the overall quantisation error in the watermarked signal 102 is spectrally shaped for reduced audibility and thus increased transparency of the watermark. They shape the white quantiser noise with an all-pole transfer function, as in FIG. 7 of Gerzon. A reasonable filter G(z) for operation at 44.1 kHz is:

$$G(z)=1+1.2097z^{-1}+0.2578z^{-2}+0.1742z^{-3}+0.0192z^{-4}-0.2392z^{-5}$$

For later reference, the sum of the absolute values of the impulse response of 1/G(z) is less than 27.

The 15.5 bit quantisations are coarser than the 16 bit quantisation of the encoder input signal. Consequently, even though g<1, there are sometimes multiple input values to 111 which quantise to the same value of 103. When this occurs, ambiguity resolver 113 (which sees signal 105, a scaled version of the quantiser error introduced by 111) outputs data 141 indicating which of the possible input values was actually presented. Along with formatting overhead, this reconstruction data 141 is multiplexed with the desired watermark into data 143.

Figure 2:
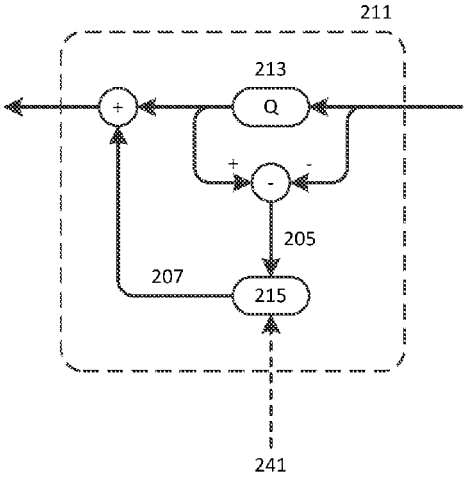
FIG. 2 shows detail of the operation of quantiser 211 in FIG. 1B for use with a two-channel signal.

Correspondingly, the decoder extracts reconstruction data 241 from 243 and uses it to adjust the output from 211 on those occasions when multiple input values to 111 could have produced the same value 103. Quantiser 211 is expanded in FIG. 2. FIG. 2 shows how the input signal is first quantised 213 to the nearest value and the quantisation error 205 fed to adjuster 215. It turns out that for any gain value g, the quantisation error 205 suffices to indicate how many input values to 111 could have produced the 103. If the answer is more than one, adjuster 215 consumes data from 241 to determine the adjustment 207 to add to the output of 213. Consequently, this ancillary data 241 ensures that 201 replicates 101 even when some other quantised value may be slightly closer to the input of quantiser 211.

The use of a 15.5 bit quantiser above does complicate operation compared to the 15 bit quantiser described in WO2004066272. It is useful though because it means the watermarking adds half as much noise as if a 15 bit quantiser is used making the watermarker more transparent. The process could be taken further, for example using a 15.75 bit quantiser that jointly quantised 4 samples, 1 on each of 4 samples or 2 successive samples on each of 2 channels would halve the added noise again. However, our embodiment only processes 2 channels and there would be greater complexity in jointly quantising successive samples.

Figure 3:
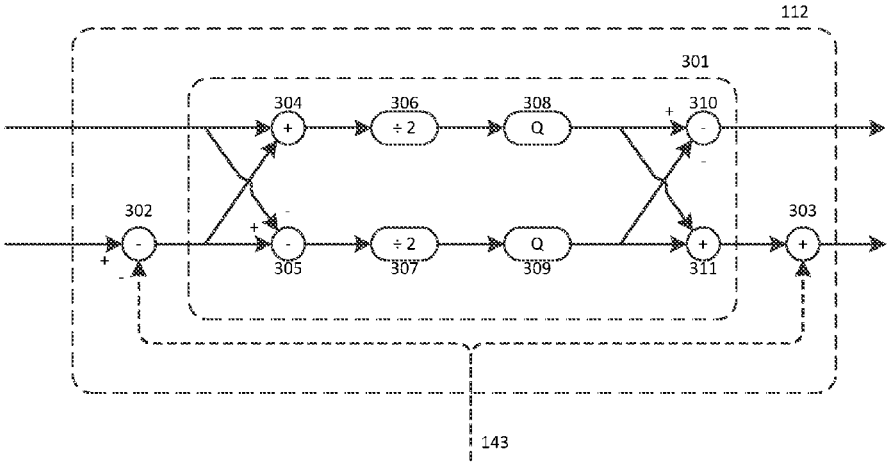
FIG. 3 shows detail of the operation of quantiser 112 in FIG. 1A for use with a two-channel signal.

FIG. 3 shows an example of a 15.5 bit quantiser 112. Box 301 implements a 15.5 bit lattice quantiser which takes its two channel input and forms half sum and difference of the channels by elements 304-307. 16 bit quantisers 308 and 309 then quantise the channels and the output is formed by a further sum and difference. The possible outputs of 301 are pairs of integers whose lsbs are either both 0 or both 1.

Box 301 is expanded to box 112 by subtracting 302 a bit of data 143 (scaled to be 0 or $2^{-16}$) from one channel prior to box 301 and adding it back 303 afterwards. If the bit is a zero, then 112 quantises onto the lattice quantisation grid with offset [0,0]. If it is a one, then 112 quantises onto the lattice grid with offset $[0,2^{-16}]$, where the lsb of one channel is 0 and the other 1.

Referring back to FIG. 1B, data 243 is produced by inspecting the parity of pairs of lsbs of corresponding samples from the two channels to determine which offset was used in the 15.5 bit quantisation. If the channels have the same lsb, then a zero is produced into 243 or if different lsbs then a one is produced.

Figure 4:
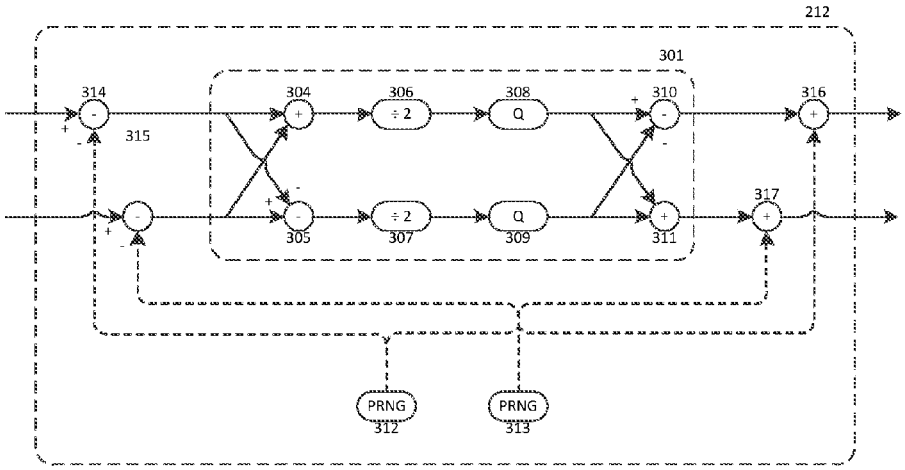
FIG. 4 shows detail of the operation of quantiser 212 in FIG. 1B for use with a two-channel signal.

Quantiser 212 quantises to the same resolution as 112. As shown in FIG. 4 it is very similar to quantiser 112, except that the offset $O_3$ is pseudo-randomly chosen rather than a data driven selection between two offsets. Accordingly, two samples from a pseudorandom number generator (PRNG) generating values between 0 and $2^{-15}$ are used to create a 2D offset for the quantisation grid $G_3$ from the constant grid 301 quantises to. This offset is subtracted from the input to 301 and added to the output of 301.

There are other ways of achieving the same effect, for example the outputs of 312 and 313 could be subtracted immediately prior to quantisers 308 and 309 and added back immediately afterwards. Such schemes differ however in the mapping between values from 312 and 313 and the choice of offset $O_3$, so a compatible choice needs to be made between decoder quantiser 212 and encoder quantiser 111.

So long as the lattice quantisers 308 and 309 used in 112 and 212 are compatible with each other, decoder quantiser 212 will remove the quantisation error introduced by 112, restoring signal 203 to be a replica of signal 103. However, compatible does not mean identical. In this embodiment $Q_{112}(x)=\Delta(\text{ceiling}(\Delta^{-1}x-0.5))$ and $Q_{212}(x)=\Delta(\text{floor}(\Delta^{-1}x+0.5))$ where $\Delta$ is the stepsize $2^{-16}$. Sufficient conditions for compatibility are $Q_{112}(x)=-Q_{212}(-x)=Q_{112}(x-\Delta)+\Delta$ for all x.

Quantiser 111, also quantises to 15.5 bits with offset $O_3$ and the architecture should match that of 212 so that it has the same mapping from pseudo-random numbers to $O_3$. The choice of offset $O_3$ needs to match in both encoder and decoder, so the pseudorandom number generators in 212 must be synchronised to match those in 111. This can be done by embedding synchronisation information (such as sample number) periodically in data 143.

Figure 5A:
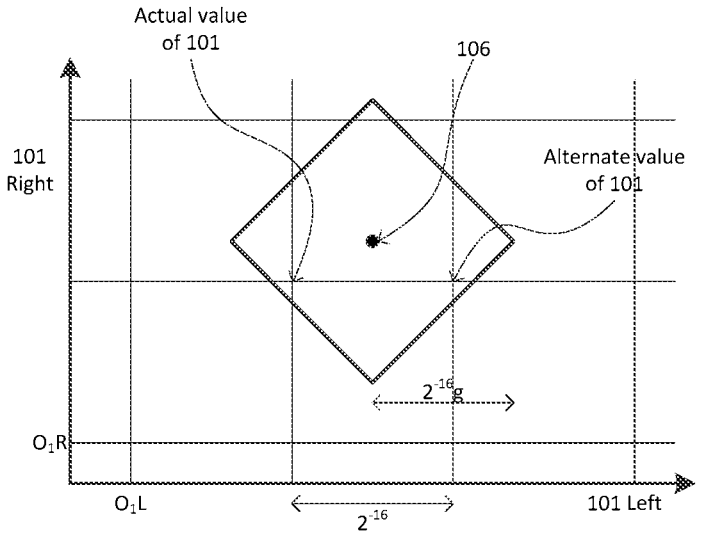
FIG. 5A shows a graph of a Veroni region of quantiser 111 in FIG. 1A when adapted for use with a two-channel signal.
Figure 5B:
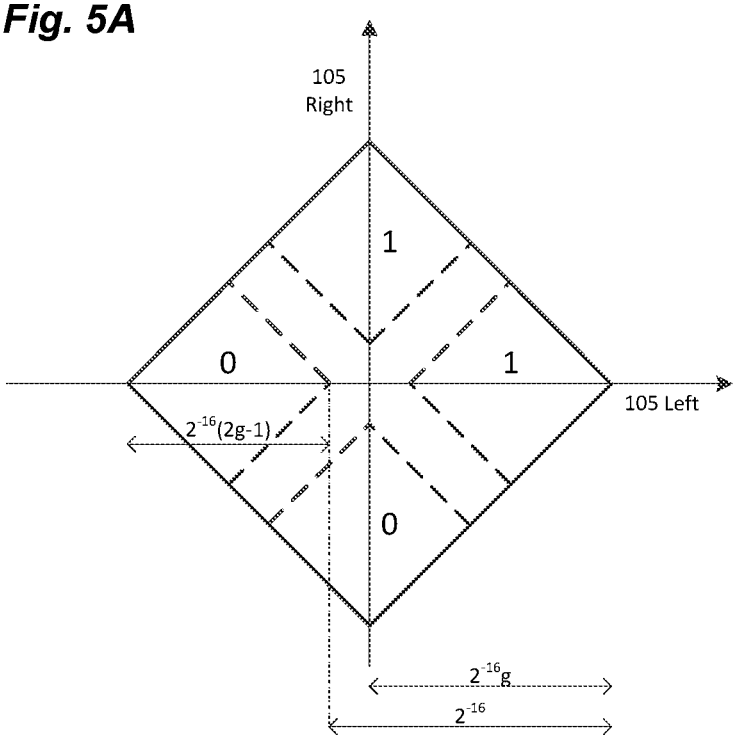
FIG. 5B shows an expanded graph of the Veroni region.

FIGS. 5A and 5B shows how data 141 is produced from scaled error quantiser error signal 105. (To avoid confusing the diagram, the output from noise shaping filter 121 is supposed to be zero).

In the graph shown in FIG. 5A, the axes are the left and right channel of signal 101, with the grid of horizontal and vertical lines corresponding to allowable quantised values that could be presented on the input (as given by the 16 bit lattice and offset $O_1$).

One of these intersections is labelled as representing the actual value presented on this illustrative occasion. After division by g, quantisation by 111 and multiplication by g, an illustrative value for signal 106 is shown. The Veroni region for quantiser 111 described above is a diamond shape. It is shown scaled by g on the graph of FIG. 5A. Of course, the actual value of 101 lies within this region since signal 101 divided by g quantised to signal 106. If it were the only value that did then a corresponding decoder would be able to uniquely identify the actual value of 101 from the value of 106. In the case shown there is one other possible value shown that would also have produced the given value of 106, so the decoder will need a bit of additional information 141 to resolve which of the quantised values lying in the Veroni region it should output.

The graph shown in FIG. 5B expands the Veroni region, which is centred on signal 105=0. If signal 105 lies within any of the dashed diamonds, then there is another possible value for signal 101 lying in the opposite dashed diamond (which is translated in one dimension by ±g) and ambiguity resolver 113 needs to send a bit of information in data 141 to resolve which of the two opposites should be produced by the decoder. For example, if signal 105 lay in the left diamond then a zero could be sent whilst if it lay in the right diamond then a 1 could be sent. Likewise a 0 could be sent for the bottom diamond and a 1 for the top diamond. Alternatively, if the value for signal 105 lies in no dashed diamond, then it must lie in the central cross region. Here there is no alternative possibility for signal 101 and no data need be sent. For this choice of quantiser, there is never any possibility of more than 2 values lying in the Veroni region so data 141 has at most 1 bit per sample.

The width of each dashed diamond is 2 g−1, so if g<0.5 then the dashed diamonds disappear and there is never any ambiguity to resolve. Also for g=1, the cross disappears and so the datarate on 141 is always 1 bit per sample which saturates the data capacity of quantiser 112 leaving no spare capacity for overhead or watermark. Hence the requirement that g<1.

Under certain circumstances, inaccuracies in computing the dashed regions can be tolerated. It is important that the encoder computations must exactly match the computations performed in the decoder (else encoder and decoder operation would diverge). It is also important that the dashed regions are not computed too small, otherwise there could be values of signal 201 which the decoder cannot produce. But it isn't a big problem if the dashed regions are a little larger than strictly required. This consequence of this inaccuracy is that occasionally a data 141 carries a bit of data it didn't need to, slightly wasting data capacity.

Small errors in the computation of signal 105 (such as fine quantisation if the decoder multiplication 231 by g produces an inconveniently large wordwidth) can thus be accommodated so long as the decoder makes matching approximations (in 231) and they both pad out the size of the dashed diamonds to accommodate the worst case inaccuracy.

In the decoder, the output of quantiser 213 is one possible value that might have been presented to the encoder. Adjuster 215 can make a corresponding decision to ambiguity resolver 113 as to whether a reconstruction bit needs pulling in from data 241. If it is needed and the bit indicates the opposite dashed diamond to the one 205 lies in, then adjuster 215 outputs an adjustment signal 207 to adjust the output of quantiser 211 to the correct value to replicate signal 101. Any adjustment will be ±1 lsb on either the left or the right channel.

Clip

Due to the gain element 131, signal 103 will exceed the representable range of 16 bit audio, and clip 133 is there to bring the signal back into the representable range so that the watermarked output 102 does not overload.

For much of the signal range, the clip unit 133 makes no modification of the signal. Near ±full scale it has a small signal gain of <1 and maps multiple values of its input onto specific values of its output. When this occurs, it generates clip reconstruction data 142 specifying which of the multiple values was actually presented. The clip reconstruction data 142 is combined with the reconstruction data 141 and watermark to form the data 143.

The unclip unit 233 is the inverse of the clip unit. For much of the signal range it makes no modification of the signal. Near ±full scale it has a small signal gain of <1 and maps specific values of its input onto multiple values of its output. When this occurs, it consumes clip reconstruction data 242 to choose which of those multiple values it actually outputs. Clip reconstruction data 242 is extracted along with reconstruction data 141 and the watermark from data 243. The operation here is as described in WO2013061062, for example as shown in FIG. 11 thereof.

For simplicity in this embodiment we have both signals 103 and 104 quantised to a 15 bit lattice (with no offset) which is a subset of the 15.5 bit lattice and so does not alter the quantisation offset of signal 104. When a channel is not clipping, we desire it to pass through the clip completely unmodified and so when a channel does clip we choose it to alter the signal by a multiple of $2^{-15}$ in order that we stay on the same quantisation offset without altering the other channel.

This 15 bit quantisation of the adjustment due to clipping is as loud as the other noise sources put together and not noise shaped. We consider that acceptable in our quest for higher transparency because it only occurs during clipping when the signal is loud, and undergoing distortion from the soft clip. Moreover in a later embodiment we describe the use of filtering which can greatly reduce the incidences of signal clipping. The combination of gain and clip gives the sigmoid transfer function C of WO2004066272. One might well wonder why we choose to combine a linear gain with a sigmoid clipping function rather than perform it all in one stage, especially as if it was performed in one stage the additional 15 bit noise source wouldn't be introduced.

The answer is that we expect to wish to alter the gain g from sample to sample and believe that the complexities of constructing the ambiguity resolver 113 and adjuster 215, especially given our randomised 15.5 bit joint quantisation grid $G_3$ would outweigh the disadvantage of the noise introduced by this method.

Initialisation

As described above, lossless reconstruction of signal 201 requires the outputs from filters 221 and 222 to match those of filters 121 and 122 in the encoder. This requirement is satisfied if the decoder was operating losslessly on the preceding samples, and it is also satisfied at the start of an encoded track when both encoder and decoder can have their respective filter states initialised to a common value such as zero. However, useful operation of a decoder also requires the ability to start up part way through an encoded stream, which makes spectrally shaping the quantisation noise trickier than one might at first suppose.

Figure 6:
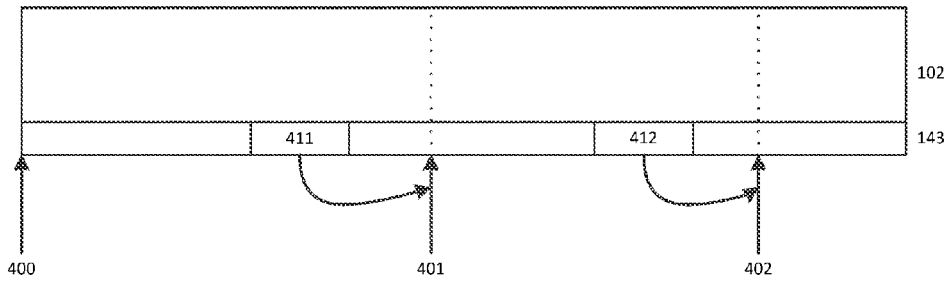
FIG. 6 represents a stream of PCM audio watermarked according to the invention showing two restart points and restart assistance data encoded prior to each of the two restart points.

In our embodiment, we provide for certain points in the stream to be restart points, as illustrated in FIG. 6. The watermarked audio 102 is shown, with the data channel 143 as the XOR of its lsbs. 400, 401 and 402 are restart points where the decoder will be able to commence lossless decoding of the original audio. Restart point 400 is at the start of the track, and here filters 221 and 222 can be initialised to 0, matching a similar reset at the encoder. Restart points 401 and 402 however are in mid-track and so the buried data 143 has to contain restart assistance information 411 and 412 which will be used to initialise filter state for starting up the decoder to decode losslessly from 401 or 402.

Now the restart assistance information 411 is buried before the corresponding restart point 401 so that the decoder can be armed with the data when it needs to use it to initialise filter state at 401. Now altering the buried data 143 at a point affects the quantisation of 112 and the filter 122 means that this altered data affects subsequent quantisations as well. If the restart assistance data 411 depended on the state of the filter 122 at the restart point 401, we would have an awkward circularity for the encoder to resolve since that state depends on the earlier buried data.

Fortunately, an all-pole noise shaping architecture in which (G−1) is a Finite Impulse Response (FIR) filter allows this circularity to be avoided. The state of filter 122 is the difference between recent values of the intermediate signal 104 and the watermarked signal 102. As the decoder approaches restart point 401, it has access to signal 202 prior to the restart point, a replica of 102. So it suffices for the restart information to allow reconstruction of intermediate signal 104 for n samples immediately prior to 401, where the output of filter 122 is a function of the previous n values of its input. Since signal 104 does not depend on the buried data 143, the circularity is avoided.

The restart information could contain a complete copy of those n samples of signal 104 but if restart points are frequent then this could be an inconveniently large amount of data. We now present a method which allows rather less restart information to suffice.

Signals 104 and 102 only differ by a noise shaped quantisation, and so their difference is bounded. This bound can be computed from the impulse response of the noise shaping transfer function and the magnitude of the quantisation error. In our embodiment the quantiser 211 produces a maximum absolute error on a channel of $2^{-16}$ g<$2^{-16}$. And the sum of the absolute values of the impulse response of the noise shaping filter 1/G(z) is less than 27. So the difference between signals 104 and 102 lies in the range ($-27\times2^{-16}$, $27\times2^{-16}$). Moreover the lsbs of signal 104 on any sample are known to the decoder from the defined quantisation grid $G_3$. Thus, only 6 bits of restart assistance data per sample are needed (this is quite a conservative bound and fewer will often suffice).

Figure 7:
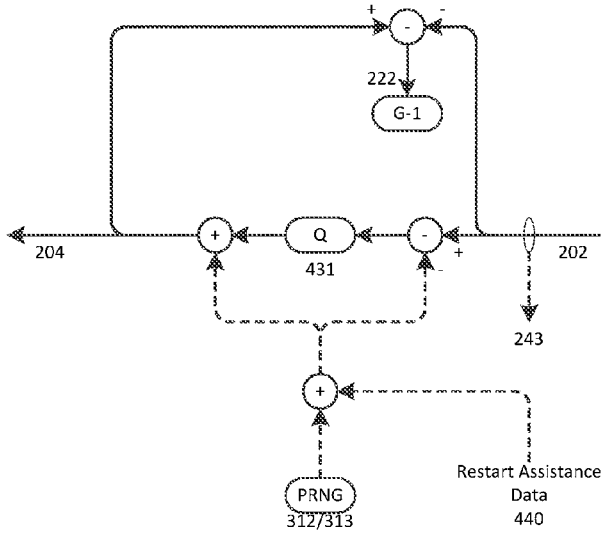
FIG. 7 shows an alternative configuration for part of the decoder shown in FIG. 1B, for use immediately after a restart point.

Startup operation for filter 222 is illustrated in FIG. 7. In contrast to normal operation, the output from filter 222 is ignored. Rather quantiser 431 generates 204 by quantising 202 to a coarse subset of the 15.5 bit quantisation with offset $O_3$ as discussed below. With the correct value for signal 204 computed, we have the correct input for filter 222 and after n samples later filter 222 has correct state and we can revert to normal operation.

In our example, quantiser 431 is a 10 bit lattice quantiser and the offset is given by the sum of 6 bits of restart assistance data scaled by $2^{-16}$ and the output of PRNG 312 (or 313 for the other channel). PRNG 312 ensures that signal 204 has the correct offset $O_3$ compared to a 15.5 bit quantisation and the restart assistance selects the correct value nearby to the input signal 202.

The encode side of this would ideally requires that bits 11 to 16 of signal 104 are pushed to the restart assistance. However, the PRNG value ranged up to $2^{-15}$, so there is one bit of overlap between the PRNG and the assistance. Since the decoder adds the values, the encoder must subtract the top bit of the PRNG output from the lsb end of bits 11 to 16 of signal 104 to generate the restart assistance. Filter 221 can be initialised in a similar manner.

Filtering

As discussed in WO2013061062, it can be useful to precede such a histogram altering lossless watermarker with pre-emphasis filtering. There it was done as an entirely separate preprocess, which of necessity involves requantisation back to the 16 bit level.

According to a further embodiment of the invention, the encoder is preceded by a filter with unity first impulse response and whose output is quantised to a finer precision than 16 bits, say 24 bits.

Figure 8A:
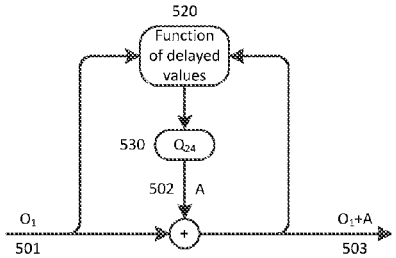
FIG. 8A shows how a PCM audio signal by may be modified by adding a more finely quantised function of previous sample values to the signal.

A generalised form of such a filter is shown in FIG. 8A. A function 520 is computed of n delayed values of the filter input 501 and output 503 and the result quantised 530 to produce signal 502, whose value at any instant we will call A (for adjustment). The filter output 503 is formed by adding signal 502 to signal 501. If the quantiser 530 were to quantise to the 16 bit precision that the encoder operates on, then this is not materially different to the lossless preemphasis filter in WO2013061062. However, the quantiser 530 is then an extra source of unshaped 16 bit noise which is undesirable.

Surprisingly however, the filter-encoder combination is still invertible even if the quantiser 530 quantises to finer precision, for example 24 bits. Now the noise introduced by quantiser 530 is far lower and does not make a material contribution to the overall noise introduced by the invention.

Signal 501 is quantised to a 16 bit lattice with offset $O_1$, and A is a function of previous samples. Despite A being higher precision, signal 503 can thus be said to be quantised to a 16 bit quantisation grid ($O_1$+A). This does not affect subsequent encoder operation (since the operation of ambiguity resolver 113 only depends on the input using a 16 bit lattice, not the quantisation offset), but it does affect decoder operation.

Figure 8B:
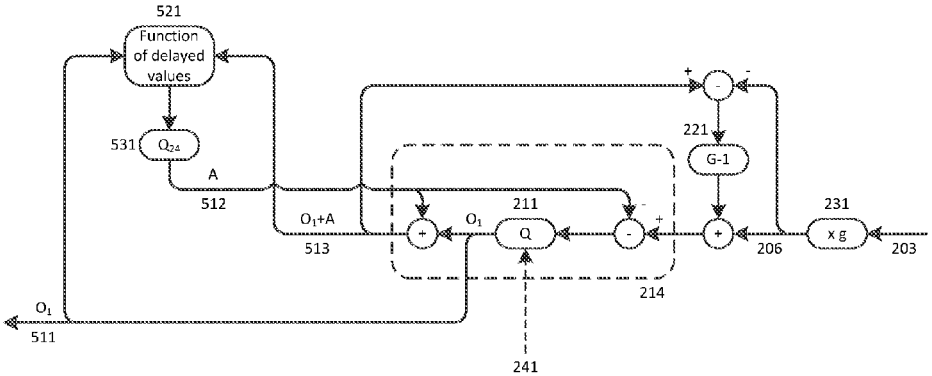
FIG. 8B shows how the latter stage of the decoder shown in FIG. 1B may be modified in order to permit the signal modification of FIG. 8A to be inverted losslessly.

Decoder operation is shown in FIG. 8B which shows modifications to the left hand side of the decoder shown in FIG. 1B. Assuming previous lossless operation, the decoder can compute the same function 521 of the replicated previous samples as the encoder and perform the same quantisation 531 to produce signal 512 whose value is also A, replicating signal 502.

However, it does not subtract A from the output of quantiser 211, since this would alter the quantisation offset. Instead it subtracts A before quantiser 211. The output of quantiser 211 is thus the filtered signal, quantised with offset $O_1$ as required for signal 511 to replicate signal 501 and serve as the decoder output and one of the inputs into function 521.

A is then added which gives a signal with quantisation offset ($O_1$+A) replicating signal 503 which is exactly as required for the other input into function 501 and the subtraction node feeding noise shaping filter 221. For interest, we point out that the dashed box 214 forms a 16 bit quantiser with quantisation offset ($O_1$+A).

As with the noise shaping though, the above logic fails when starting decoder operation in the middle of a track and restart assistance data is required to bootstrap lossless operation. Most simply, the restart assistance could comprise a snapshot of the correct filter state but if restart points are frequent then this could be an inconveniently large amount of data.

We now explain how the amount of restart assistance data can be substantially reduced. We make the following preliminary observations:

The feedback of signal 512 to quantiser 214 means that the quantiser and filter need bootstrapping as a combined unit. There is no point initialising 214's noise shaping if we don't also bootstrap the filter because wrong values of signal 512 cause quantiser 214 to quantise to the wrong grid and so not operate in a lossless manner. This is a key difference from the preemphasis in WO2013061062 which was not integrated into the quantiser.

As with the noise shaping, if signal 513 and 511 are correct for n samples, then signal 512 will be correct and lossless operation will follow if quantiser 214's noise shaping is also correct.

Signal 513 is also the signal that needs to be correct to bootstrap the noise shaping.

Signal 513 is close to signal 206, differing only by the noise shaped alteration introduced by quantiser 214. However, signal 511 is a filtered version of 513 and substantially different.

Figure 9:
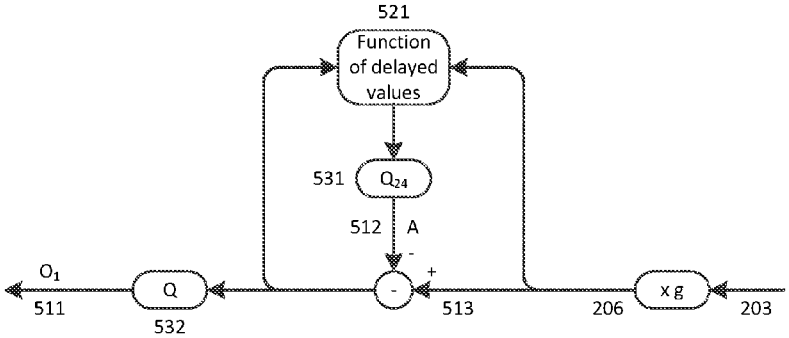
FIG. 9 shows how the part of a decoder shown in FIG. 8B can be modified in order temporarily to provide lossy reconstruction of an original signal pending receipt of the restart information required to provide initialise the lossless reconstruction shown in FIG. 8A; and, FIG. 10 shows how watermark data may be extracted from a stream watermarked according to the invention, then how the stream may be watermarked with alternative watermarking data, without full decoding and re-encoding of the audio signal.

If the decoder is started at an arbitrary point within a stream, it will in general not immediately see a "restart point" at which restart assistance data is provided, and will run in a lossy mode initially, as shown in FIG. 9. FIG. 9 is derived from FIG. 8B by eliminating the noise shaped quantisation 214, subtracting the adjustment A and finally quantising the result so the output conforms to being 16 bit with offset $O_1$, even though it does not replicate signal 501 provided to the encoder.

We operate in this lossy mode for sufficient time to allow signal 511 to converge towards the correct value it would have in lossless operation. How long this needs to be is related to the length of the impulse response of the filter, which is in general IIR because of the feedback path round the function 521 and quantiser 531. But there is a limit to how close signal 511 will converge, set by its input being inaccurate because quantiser 214 isn't operational in lossy mode. Restart assistance is needed at the restart point to snap approximate delayed values of 511 and 513 to the correct values.

As in the previously discussed case of initialising just the noise shaping, the restart information can be verbatim bits of the lossless signals. For signal 511, the bits below 16 are defined by quantisation offset $O_1$, so each delayed datum needs some number of lsbs from the $16^{th}$ bit upwards specifying, with the number depending on how much error there may be in the approximate signal 511. Eight bits is likely to suffice if the IIR filter comprising function 521 and quantiser 531 has had adequate time to settle and does not have too extreme a response. For signal 513 we need more bits than in the noise-shaping-only case because the signal is quantised on a grid ($O_1$+A) and we don't know A accurately. So, if 6 bits would have sufficed for the noise shaper and A is quantised to 24 bits, we now need 14 bits per datum, conveying the 11-$24^{th}$ bits of the lossless signal.

Sprinkler

Figure 10:
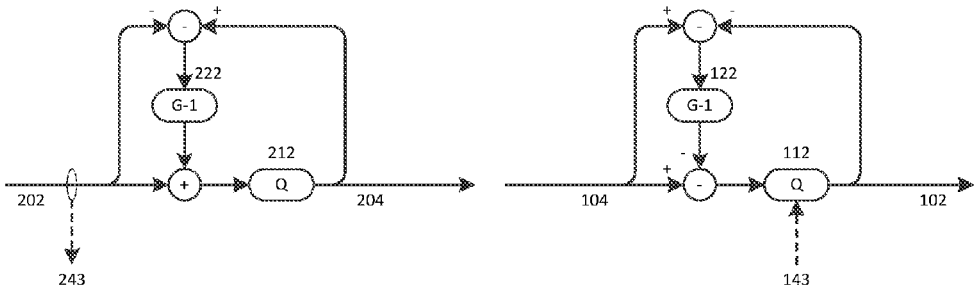

FIG. 10 shows another embodiment of the invention, where a losslessly watermarked audio file 202 has its watermark altered to produce a different losslessly watermarked audio file 102.

This is done by using the initial part of the decoder from FIG. 1B to regenerate the internal signal 204 quantised to grid $G_3$, which then passes into the latter part of the encoder from FIG. 1A to embed altered data 143. Only the watermark part of data 143 is altered, reconstruction data and restart assistance pass unchanged.

The invention claimed is:

1. A method for losslessly watermarking a first audio signal to generate a second audio signal, wherein the first and second audio signals are pulse code modulated 'PCM' signals, the method comprising:

receiving the first audio signal as samples quantised on a first quantisation grid;

determining a third quantisation grid coarser than the first quantisation grid;

applying a quantised mapping to the first audio signal to furnish a third audio signal having sample values that lie on the third quantisation grid;

generating first data when multiple values of the first quantisation grid would be mapped to the value of the third audio signal by the quantised mapping, wherein the first data is reconstruction data that indicates which of the multiple values is the value of the first audio signal;

combining the first data with watermark data to produce second data;

determining a second quantisation grid different than the first and third quantisation grids in dependence on the second data; and, generating samples of the second audio signal by quantising the third audio signal onto the second quantisation grid in dependence on previous samples of at least one of the second and third audio signals.

2. A method according to claim 1, wherein at least one of the first and third quantisation grids varies from sample to sample.

3. A method according to claim 1, wherein the third quantisation grid is determined in dependence on the output of a pseudo-random sequence generator.

4. A method according to claim 1, wherein the first, second and third audio signals are multichannel and at least one of the second and third quantisation grids is not formed as the Cartesian product of an independent quantisation grid on each channel.

5. A method according to claim 1, wherein the quantised mapping is preceded by a filter whose output is quantised more finely than the first quantisation grid.

6. A method according to claim 1, wherein the second data also comprises initialisation data relating to consecutive samples of the third audio signal.

7. A method according to claim 6, wherein the total number of bits within the initialisation data does not exceed 8 times the number of channels times the number of consecutive samples of the third audio signal.

8. A method for retrieving a first audio signal and watermark data from a portion of a second audio signal, wherein the first and second audio signals are pulse code modulated 'PCM' signals, and wherein the second audio signal is a losslessly watermarked PCM signal and the first audio signal has samples that lie on a first quantisation grid, the method comprising:

determining a third quantisation grid;

receiving the second audio signal as quantised samples;

retrieving first data and the watermark data from the second audio signal, wherein the first data is reconstruction data for use in retrieving the first audio signal;

generating samples of a third audio signal, quantised onto the third quantisation grid, by quantising samples of the second audio signal in dependence on previous samples of at least one of the second and third audio signals;

applying a quantised mapping to the third audio signal in dependence on the first data to furnish a mapped signal; and, furnishing the first audio signal in dependence on the mapped signal.

9. A method according to claim 8, wherein the first audio signal replicates a portion of an original PCM audio signal having samples that lie on a first quantisation grid and the second audio signal is a watermarked version of the original PCM audio signal.

10. A method according to claim 9, wherein the third quantisation grid is coarser than the first quantisation grid.

11. A method according to claim 8, wherein at least one of the first and third quantisation grids varies from one sampling instant to another.

12. A method according to claim 8, wherein the third quantisation grid is determined in dependence on the output of a pseudo-random sequence generator.

13. A method according to claim 8, wherein the first, second and third audio signals are multichannel and at least one of the second and third quantisation grids is not formed as the Cartesian product of an independent quantisation grid on each channel.

14. A method according to claim 8, wherein the mapped signal is the first signal.

15. A method according to claim 8, further comprising the steps of:

determining a fourth quantisation grid finer than the first quantisation grid;

computing an adjustment sample dependent on previous samples of at least one of the first audio signal and the mapped signal, the adjustment sample having a value lying on the fourth quantisation grid; and, adding the adjustment sample to the mapped signal.

16. A method according to claim 8, wherein the second audio signal was generated using the method and wherein the step of retrieving comprises:

retrieving a replica of the second data from the second audio signal;

extracting the first data and the watermark data from the replica of the second data.

17. A method according to claim 8, the method further comprising:

retrieving initialisation data from the second audio signal; and, using the initialisation data to determine a selection of bits from consecutive samples of the third audio signal.

18. A method according to claim 17, where the initialisation data is no greater than 8 bits times the number of channels times the number of values of the third audio signal.

19. A method for altering the watermark in an input audio signal that is a losslessly watermarked PCM signal, the method comprising the steps of:

receiving the input audio signal as quantised samples;

retrieving input data comprising embedded watermark data from the input audio signal;

generating samples of an intermediate audio signal, quantised onto an intermediate quantisation grid, by quantising the input audio signal in dependence on previous samples of at least one of the input audio and intermediate audio signals;

producing output data by altering the embedded watermark data in the input data;

determining an output quantisation grid in dependence on the output data; and, quantising the intermediate audio signal to an output audio signal on the output quantisation grid in dependence on previous samples of at least one of the output and intermediate audio signals.

20. A method according to claim 19, wherein the intermediate quantisation grid varies from one sampling instant to another.

21. A method according to claim 19, wherein the intermediate quantisation grid is determined in dependence on the output of a pseudo-random sequence generator.

22. An encoder adapted to losslessly watermark a first signal comprising a pulse code modulated (PCM) audio signal to generate a second signal, the encoder comprising:

a receiver configured to receive a first audio signal as samples quantised on a first quantisation grid; and a signal processor configured to:

determine a third quantisation grid coarser than the first quantisation grid, apply a quantised mapping to the first audio signal to furnish a third audio signal having sample values that lie on the third quantisation grid, generate first data when multiple values of the first quantisation grid would be mapped to the value of the third audio signal by the quantised mapping, wherein the first data is reconstruction data that indicates which of the multiple values is the value of the first audio signal, combine the first data with watermark data to produce second data;

determine a second quantisation grid different than the first and third quantisation grids in dependence on the second data, and generate samples of the second audio signal by quantising the third audio signal onto the second quantisation grid in dependence on previous samples of at least one of the second and third audio signals.

23. A decoder for retrieving a first audio signal and watermark data from a second audio signal, wherein the first and second audio signals are pulse code modulated 'PCM' signals, the second audio signal is a losslessly watermarked PCM signal, and the first audio signal has samples that lie on a first quantisation grid, the decoder comprising:

a receiver configured to receive the second audio signal as quantised samples; and a processor configured to:

retrieve first data and the watermark data from the second audio signal, wherein the first data is reconstruction data for use in retrieving the first audio signal, determine a third quantisation grid, generate samples of a third audio signal, quantised onto the third quantisation grid, by quantising samples of the second audio signal in dependence on previous samples of at least one of the second and third audio signals, apply a quantised mapping to the third audio signal in dependence on the first data to furnish a mapped signal, and furnish the first audio signal in dependence on the mapped signal.

24. A non-transitory computer-readable storage medium comprising program instructions that when executed by a processor cause the process to perform a method for losslessly watermarking a first audio signal to generate a second audio signal, wherein the first and second audio signals are pulse code modulated (PCM) signals, the method comprising:

receiving the first audio signal as samples quantised on a first quantisation grid;

determining a third quantisation grid coarser than the first quantisation grid;

applying a quantised mapping to the first audio signal to furnish a third audio signal having sample values that lie on the third quantisation grid;

generating first data when multiple values of the first quantisation grid would be mapped to the value of the third audio signal by the quantised mapping, wherein the first data is reconstruction data that indicates which of the multiple values is the value of the first audio signal;

combining the first data with watermark data to produce second data;

determining a second quantisation grid different than the first and third quantisation grids in dependence on the second data; and generating samples of the second audio signal by quantising the third audio signal onto the second quantisation grid in dependence on previous samples of at least one of the second and third audio signals.

25. A non-transitory computer-readable storage medium comprising program instructions that when executed by a processor cause the process to perform a method for retrieving a first audio signal and watermark data from a portion of a second audio signal, wherein the first and second audio signals are pulse code modulated 'PCM' signals, and wherein the second audio signal is a losslessly watermarked PCM signal and the first audio signal has samples that lie on a first quantisation grid, the method comprising:

determining a third quantisation grid;

receiving the second audio signal as quantised samples;

retrieving first data and the watermark data from the second audio signal, wherein the first data is reconstruction data for use in retrieving the first audio signal;

generating samples of a third audio signal, quantised onto the third quantisation grid, by quantising samples of the second audio signal in dependence on previous samples of at least one of the second and third audio signals;

applying a quantised mapping to the third audio signal in dependence on the first data to furnish a mapped signal; and, furnishing the first audio signal in dependence on the mapped signal.

26. A watermark modifier adapted to alter a watermark in an input audio signal that is a losslessly watermarked, the watermark modifier comprising:

a receiver configured to receive the input audio signal as quantised samples; and a signal processor configured to:

retrieve input data comprising embedded watermark data from the input audio signal, generate samples of an intermediate audio signal, quantised onto an intermediate quantisation grid, by quantising the input audio signal in dependence on previous samples of at least one of the input audio and intermediate audio signals, produce output data by altering the embedded watermark data in the input data, determine an output quantisation grid in dependence on the output data, and quantize the intermediate audio signal to an output audio signal on the output quantisation grid in dependence on previous samples of at least one of the output and intermediate audio signals.

* * * * *